US007098862B2

(12) United States Patent
Regala

(10) Patent No.: US 7,098,862 B2
(45) Date of Patent: Aug. 29, 2006

(54) SINGLE CONNECTOR DUAL BAND ANTENNA WITH EMBEDDED DIPLEXER

(75) Inventor: Florenio Pinili Regala, Costa Mesa, CA (US)

(73) Assignee: FPR Enterprises, LLC, Costa Mesa, CA (US)

( * ) Notice: Subject to any disclaimer, the term of this patent is extended or adjusted under 35 U.S.C. 154(b) by 0 days.

(21) Appl. No.: 10/973,230

(22) Filed: Oct. 26, 2004

(65) Prior Publication Data

US 2006/0097953 A1 May 11, 2006

(51) Int. Cl.
*H01Q 1/50* (2006.01)

(52) U.S. Cl. ..... 343/850

(58) Field of Classification Search ..... 343/870, 343/700 MS, 713, 729, 752, 702
See application file for complete search history.

(56) References Cited

U.S. PATENT DOCUMENTS 4,870,426 A * 9/1989 Lamberty et al. ..... 343/727
5,568,157 A * 10/1996 Anderson ..... 343/713
6,429,821 B1 * 8/2002 Lewis, Jr. ..... 343/749
2004/0217914 A1 * 11/2004 Yamashita et al. ..... 343/850
2004/0263392 A1 * 12/2004 Bisiules et al. ..... 343/700 MS
2005/0206568 A1 * 9/2005 Phillips et al. ..... 343/700 MS

* cited by examiner

*Primary Examiner*—Hoang V. Nguyen
*Assistant Examiner*—Huedung X. Cao
(74) *Attorney, Agent, or Firm*—Jon A. Gibbons; Scott D. Smiley; Fleit, Kain, Gibbons, Gutman, Bongini & Bianco P.L.

(57) ABSTRACT

An antenna assembly (700) includes a first element (100) and a second element (300). Each element (100, 300) transmits and receives in a particular band of frequencies. Integrated on one of the elements is a diplexer (702) that allows all frequencies to be fed into the antenna assembly (700) via a single connector (600) and each element (100, 300) receives only the frequency band that that element is designed to operate in.

14 Claims, 4 Drawing Sheets

SINGLE CONNECTOR DUAL BAND ANTENNA WITH EMBEDDED DIPLEXER

BACKGROUND OF THE INVENTION

1. Field of the Invention

This invention relates in general to antennas and more particularly, to a dual-frequency-band/dual-element, single connector antenna with an embedded diplexer.

2. Description of the Related Art

Wireless communication is accomplished through use of a radio connected to an antenna. An antenna is an impedance-matching device used to absorb or radiate electromagnetic waves into the atmosphere. The function of the antenna is to "match" the impedance of the propagating medium, which is usually air or free space, to the source of the radio waves, i.e., output of the radio.

Antennas are available in many different shapes and sizes. The particular shape and size of an antenna designed for a particular application depends on many factors, such as the frequency or range of frequencies being received and transmitted, the expected environment the antenna will endure, size limitations of the structure the antenna is to be installed upon, power efficiency limitations, impedance limitations, application particulars, and many more.

Additionally, a common use of antennas is on ground or airborne vehicles. An antenna can be placed on various locations on the body of the vehicle, providing communication between the vehicle and other radio-wave-receiving entities, such as handhelds, base stations, other vehicles, and more. The communication links include ground to air, air to air, or ground to ground. All vehicles, whether airborne or terrestrial, have a finite amount of surface area in which antennas can be placed. It is therefore a common design goal to provide as efficient an antenna as possible in the smallest package possible.

Antennas that are installed on the exterior of vehicles must withstand heavy torque from wind and debris, resist moisture, withstand extreme and rapid temperature changes, heavy vibrations, and other environmental hazards. For this reason, antenna "assemblies" are utilized with includes a shell, which covers and protects the radiating portion of the antenna assembly, called the "element". The shell must be rugged and strong. Antenna shells are often constructed of fiberglass or other composite materials. Composite materials are chosen as a housing for the elements because they are lightweight, structurally robust, and allow radio waves to pass without appreciable attenuation.

The single largest dictator of the physical size of an antenna element is its intended frequency range. An antenna of a given size has an optimum frequency with which it is most efficient. Acceptable efficiency can also be realized with frequencies that vary above and below the optimum frequency, to a certain degree. For efficiency to remain at an acceptable level, the element should increase in length as the frequencies decrease. Likewise, the element should decrease in length as the frequencies increase.

In many applications, it is necessary to broadcast or receive over a relatively broad range of frequencies. As discussed in the preceding paragraph, an element of a fixed length is efficient at a single frequency, with performance dropping as the frequency varies from that single frequency. Transmitting or receiving a broad frequency range on a single element will result in poor performance and wasted power.

One Prior Art solution for transmitting and receiving one or more distinct broad ranges of frequencies has been to utilize two or more separate antennas (with separate housings), each for a specific range of frequencies, and each with a separate connector to the radio. However, mounting multiple antennas on a surface requires dedicated space for each antenna footprint. As mentioned above, antenna mounting space on vehicles is finite. Therefore, utilizing multiple antennas is disadvantageous in terms of space consumption.

Additionally, when one antenna is in close proximity, and in the beam field of another, transmits a signal, that signal will be received by the other antenna and fed back to the radio. This effect can damage the transmitting radio and is undesirable. To prevent or reduce the effects of poor frequency isolation between the antennas, a filter is used to isolate the intended frequency range of each antenna and reject frequencies outside that range. Some prior art designs provide filters in-line with the coaxial cable while other filters are integrated inside the antenna housing. Providing separate antennas with separate filters and connectors adds extra expense and additional potential failure points to the design.

Other Prior Art designs have put multiple elements of varying size inside a single antenna housing. Multiple elements in a single antenna assembly can result in a significant space saving over two separate antennas. However, elements in the same housing are in very close proximity. The small distance between the elements may cause them, as described above, to suffer from isolation problems, thereby necessitating the presence of one or more filters. Prior art antennas of this type utilize separate connectors for each element with in-line filters providing the necessary isolation between the frequency bands.

Multiple connectors on a single antenna is a disadvantage. This is because it requires a radio with multiple cables and connecters. In many vehicular applications, access to inside the area of the body where the antenna is to be installed is limited. The installation step of connecting both connectors is difficult and time consuming. Additionally, the multiple connectors creates added cost for the extra parts, added time, and cost for testing procedures, increased failure points, and many other disadvantages.

Accordingly, a need exists to overcome the shortcomings with the prior art and to provide a dual-band/dual-element antenna with a single connector that also provides adequate isolation between frequency bands.

SUMMARY OF THE INVENTION

Briefly, in accordance with the present invention, disclosed is an antenna assembly that includes two antenna elements, each element dedicated to transmitting and receiving frequencies within a specific frequency band. The antenna has a blade-like shape with a single connector that feeds both elements.

In one embodiment of the present invention, a high-frequency element is disposed on top of a low-frequency element so that each antenna is in a transmission null of the other antenna. A horizontal ground plane is provided between the two elements to provide both added gain for the high-frequency element as well as added isolation between the two elements.

In accordance with an embodiment of the present invention, a diplexer is located on the low-frequency element. The diplexer filters and separates frequency bands coming from and going to the antenna's single-connector feed point to provide isolation between the two elements. The diplexer includes passive components, such as strip line capacitors and inductors, RF chokes, capacitors, and attenuator pads.

The antenna components are protected by an outer antenna housing. In one embodiment, the antenna housing is a fiberglass material.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention, in which.

DETAILED DESCRIPTION

Figure 1:
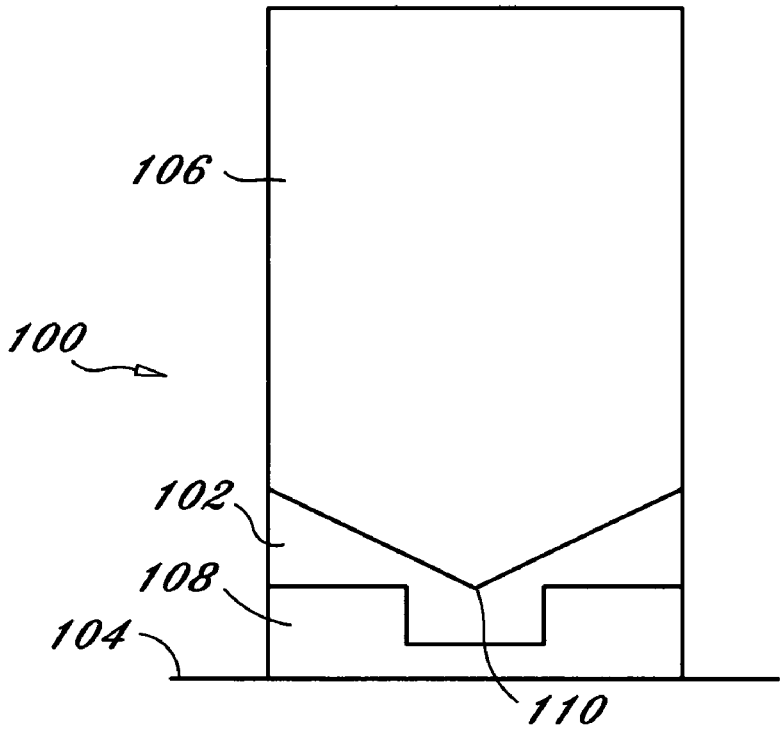
FIG. 1 is a diagram illustrating a side view of an element of the inventive antenna assembly according to an embodiment of the present invention.

While the specification concludes with claims defining the features of the invention that are regarded as novel, it is believed that the invention will be better understood from a consideration of the following description in conjunction with the drawing figures, in which like reference numerals are carried forward.

The present invention, according to an embodiment, overcomes problems with the prior art by providing an antenna that is small in size and weight, yet communicates in two frequency bands. Only one connector is needed to operate in the two bands. A high level of frequency band isolation is also obtained by a compact integrated diplexer.

Described now is an exemplary antenna configuration, according to an exemplary embodiment of the present invention. The inventive antenna is an assembly that will be described as three main components: 1) a low-frequency element ("LFE"), 2) a high-frequency element ("HFE"), and 3) a diplexer. The terms "low-frequency" and "high-frequency" are used to differentiate the elements from each other and are not intended to refer to any particular frequency range.

With reference to FIG. 1, the LFE 100 is shown. In one embodiment, the LFE includes a dielectric material 102 that is provided in a rectilinear shape. A few exemplary dielectric materials are fiberglass, plastic, and RT/Duroid, among others. The dielectric material 102 is attached to and supported by a metallic base plate 104. As will be described later, the base plate 104 is provided with holes that allow screws or bolts to secure the antenna assembly to a surface of a vehicle, such as an outside surface. The dielectric material 102 is sufficiently ridged to stand upright and perpendicular from the base plate 104.

The purpose of the dielectric material 102 is to provide support for a layer of conductive material 106 attached to the dielectric material 102. As will be described later, and in a manner that is know by those of ordinary skill in the art, when the conductive material 106 is energized with a varying voltage signal, electromagnetic energy is radiated from the conductive material (or in the alternative, the electromagnetic energy is collected with it) and wireless communication is made possible. The conductive material 106 can be almost any metallic material or a combination of various metallics, including both organic and inorganic materials.

Figure 2:
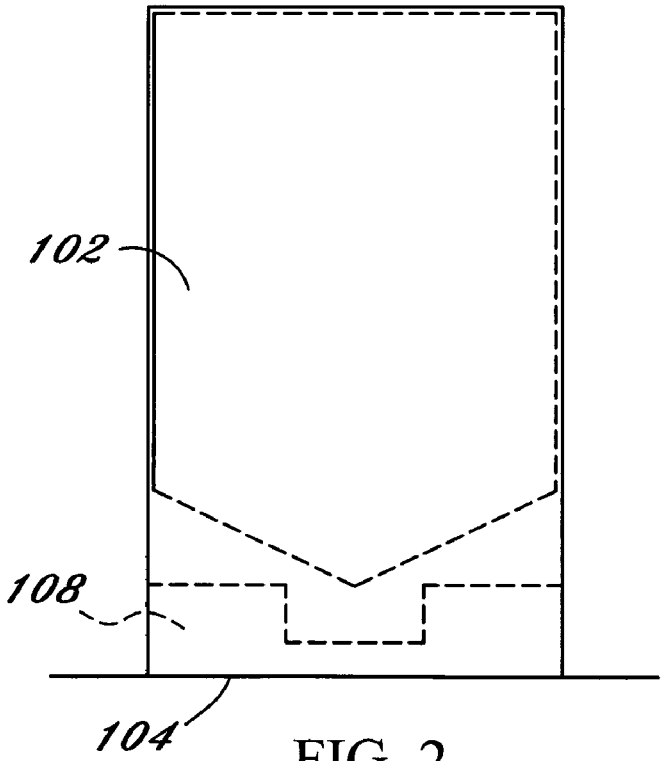
FIG. 2 is a diagram illustrating a backside view of the element of FIG. 1.

FIG. 2 shows a backside view of the LFE 100 of FIG. 1. In the embodiment shown in FIGS. 1 & 2, the conductive material 106 is spaced away from a second area of conductive material 108. In other words, there is an area located between the first area of conductive material 106 and the second area of conductive material 108 that is void of conductive material. The size and shape of the areas can differ from those shown in FIGS. 1 & 2. In the embodiment of FIGS. 1 & 2, both areas of conductive material, 106 and 108, are provided on only a single side of the dielectric material 102. This can be seen in FIG. 8, where a top view of the LFE 100 is shown. As can be seen, the dielectric material 102 is substantially flat and the conductive material 106, 108 is disposed on only a single side of the dielectric material 102.

As will be recognized by those of ordinary skill in the art, the LFE 100 just described is known as a "monopole." It has only one radiating portion 106, but operates in conjunction with the base plate/ground plane 104, which mimics the missing second radiating portion. The ground plane 104 allows the monopole to radiate and receive just as if it were a "dipole," which has two elements of equal size arranged in a shared axial alignment configuration with a small gap between the two elements. To operate a dipole, each element of the dipole is fed with a charge 180 degrees out of phase from the other. In this manner, the elements always have opposite charges and common nulls, or points of no charge.

Referring still to FIG. 1, it can be seen that the second conductive area 108 makes contact with the base plate 104, which in turn will be connected to an outer jacket of a connector (not shown) that feeds signals to the antenna 100 in a way that places the base plate 104 and conductive area 106 180 degrees out of phase with each other. Therefore, the second area 108 and the base plate 104 take the place of the missing half of the dipole configuration and have a charge with a polarity opposite that of the first conductive area 106. Accordingly, both also share common nulls.

As can also be seen in the embodiment of the present invention shown in FIG. 1, the conductive material 106 is tapered at its bottom edge 110. Tapering is known in the art and is used as a method of providing capacitance between the element and ground (ground plane 104/conductive area 108) that varies with frequency. The conductive material 106, however, does not have to be shaped in a taper and other configurations can be used without departing from the true spirit and scope of the invention.

Figure 3:
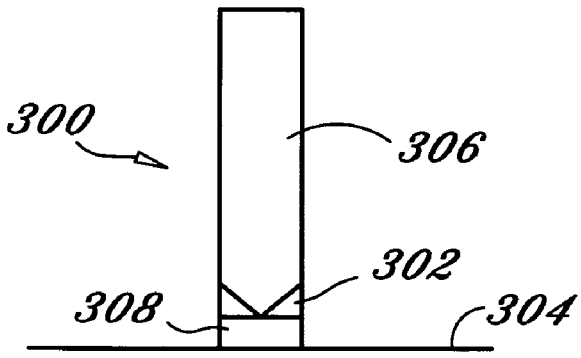
FIG. 3 is a diagram illustrating a side view of an element of the inventive antenna assembly according to an embodiment of the present invention.

Referring now to FIG. 3, an embodiment of a HFE 300 is shown. Because the HFE 300 communicates electromagnetic waves at a higher frequency than does the LFE 100, the HFE 300 is smaller in size than the LFE 100. Similar to the LFE 100, the HFE 300 includes a dielectric 302 covered with a conductive metallic material 306. The dielectric 302 is attached to a base plate 304 in a perpendicular arrangement as described with regard to dielectric 102 and base plate 104 of the LFE 100. The base plate 304 acts electrically as a ground plane for the HFE 300. The HFE 300 has a second area of metallic material 308 that is in electrical communication with the base plate 304. As will be described later, a high-frequency impedance matching network is located on the second area 308. In one embodiment of the present invention, the conductive material 306 on the HFE 300 is provided on both sides of the dielectric 302.

Figure 4:
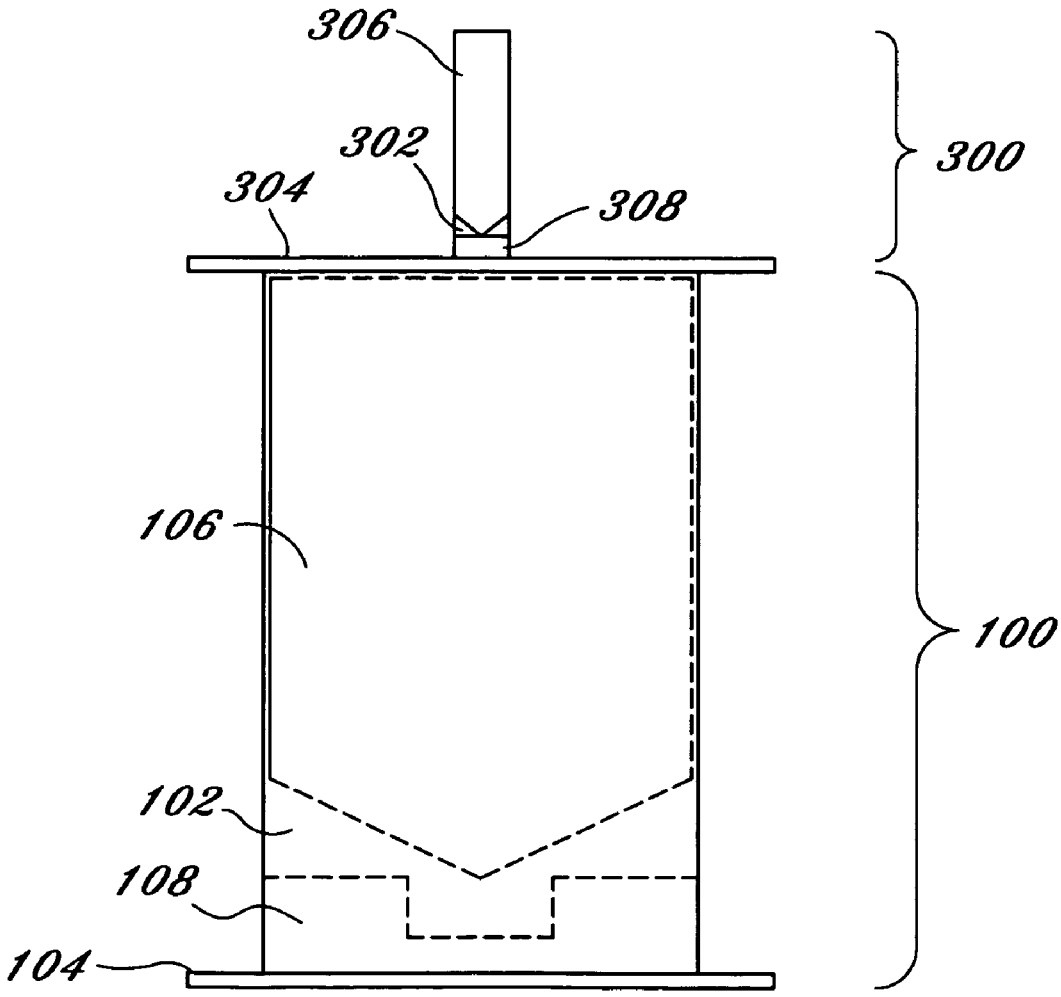
FIG. 4 is a diagram illustrating a side view of the inventive antenna assembly, showing the elements of FIGS. 1 & 2, according to an embodiment of the present invention.

FIG. 4 shows the LFE 100 and HFE 300 together in an embodiment of the present invention. The HFE 300 sits atop the LFE 100 and, in one embodiment, shares the same continuous piece of dielectric 102/302. As is known by those of average skill in the art of wireless communication, monopoles and dipoles have "nulls," or areas of low or no radiation, at areas coaxial with the longitudinal axis of the elements. Placing the LFE 100 and the HFE 300 in a coaxial arrangement, as shown in FIG. 4, places the two elements in each other's null zone and greatly increases the isolation between the frequency bands of the two elements.

Increasing the length of an antenna to its resonant length increases its radiation resistance, and, as a result, its performance. In applications where increased length is not practical, replacing the missing height with some form of electrical circuit having the same characteristics as the missing part of the antenna provides significant improved performance. One such technique is to attach a flat top or plate to the upper section of the element. The flat top, or "top load," supplies a capacitance at the top of the element into which current can flow. The base plate 304 of the HFE 300 is electrically connected to the conductive material 106 on the LFE 100. The ground plane serves to function as a top load for the LFE 100. In an embodiment of the present invention, base plate 304 is circular and has a radius that is at least ¼ wavelength of the lowest frequency the HFE is to operate.

Figure 8:
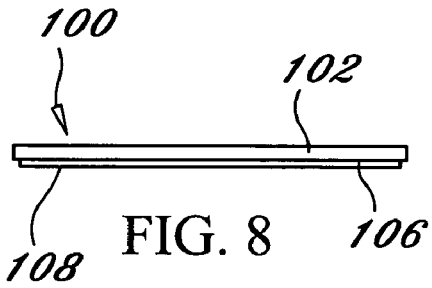
FIG. 8 is a diagram illustrating a top view of the low frequency element, according to an embodiment of the present invention.
Figure 9:
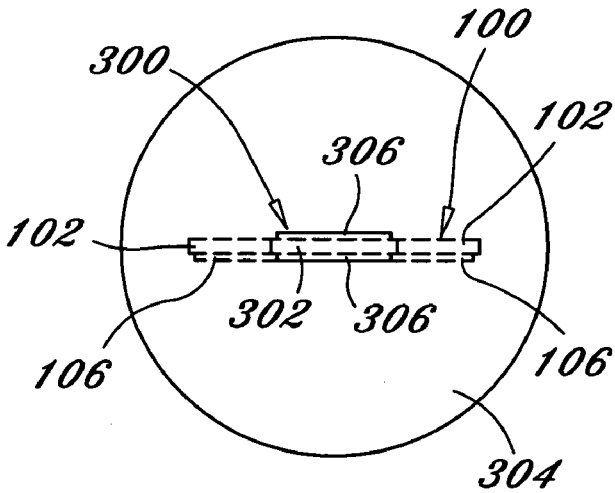
FIG. 9 is a diagram illustrating a top view of the low frequency element, high frequency element, and base plate according to an embodiment of the present invention.

Referring now to FIG. 9, a top view of the HFE 300 sitting atop the LFE 100 with the base plate 304 disposed between the HFE 300 and LFE 100 is shown. The HFE 300 includes substantially flat dielectric substrate 302 sandwiched on both sides by conductive material 306 and 308 (not shown). The base plate 304 sits atop the LFE 100 as shown in FIG. 8, which is indicated with broken lines. The HFE 300 and base plate 304 can be replaced with a dipole configuration of an equivalent resonant length.

Figure 5:
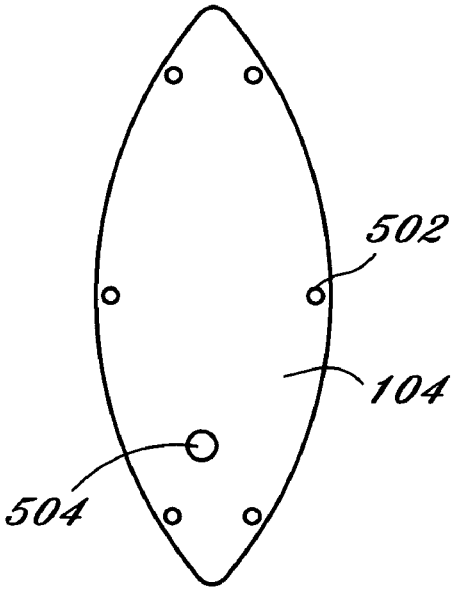
FIG. 5 is a diagram illustrating a base plate of the inventive antenna assembly, according to an embodiment of the present invention.

Referring now to FIG. 5, the LFE 100 ground plane 104 is shown from a bottom view. The ground plane 104 is constructed of a metallic conductive material such as aluminum, copper, brass, iron, or steel, or combinations thereof and other organic and inorganic materials which can be used as a conductor. It is provided with a group of openings 502 for inserting attachment means including bolts, screws, rivets, and welds (all not shown) for attachment to a surface of a vehicle. Preferably, the vehicle, or at least the surface area of the vehicle where the antenna assembly is to be mounted is a conductive material, such as aluminum. The attachment of the base plate 104 to the conductive material creates electrical continuity between the vehicle and the base plate 104. Conductive grease or epoxy, in one embodiment, is used to improve continuity. The coupling of the base plate 104 and vehicle surface forms a ground plane for the LFE 100 that is larger than the actual base plate 104. The base plate 104 is not limited to the size or shape shown in FIG. 5, nor is it limited to the number or type of attachment means just described.

There is also an opening 504 in the base plate 104. Opening 504 is provided for the insertion and attachment of a connector 600, shown in FIG. 6. The connector 600 is shown as a side view in FIG. 6, and is the connection point between the antenna assembly and the radio. The connector 600 includes three main components: 1) the outer body 602, 2) the center conductor 604, and 3) an insulator 606. The outer body 602 is placed within the opening 504 in the base plate 104 so that both the outer body 602 and base plate 104 are in electrical communication with one another. The outer body 602 has threads 608 that accepts the outer nut of a coaxial cable (not shown). The center conductor 604 is electrically insulated from the outer body 602 by the insulator 606. The center conductor of a coaxial cable feeding the antenna assembly is electrically coupled to the center conductor 604 of the connector 600.

Figure 6:
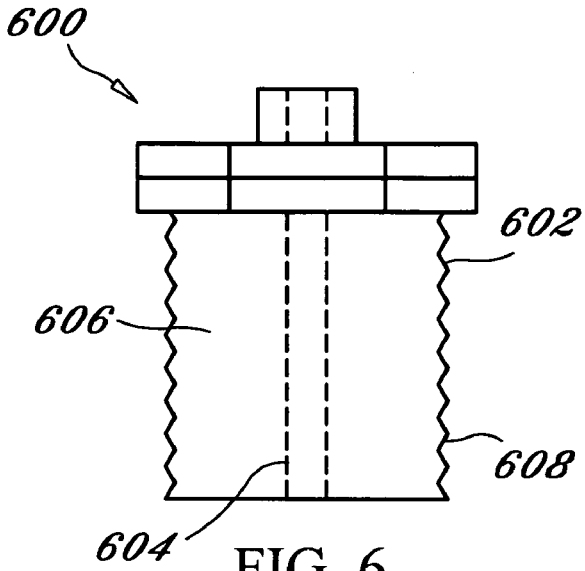
FIG. 6 is a diagram illustrating a prior art electrical connector for electrically coupling an antenna.

All frequency bands that the antenna assembly will communicate in are input or output from the single connector 600. The particular connector type shown in FIG. 6 is for exemplary purposes only and other types of connectors may be used without departing from the true spirit and scope of the invention. Examples of other connector types are BNC, TNC, N-Type, and SMA.

Figure 7:
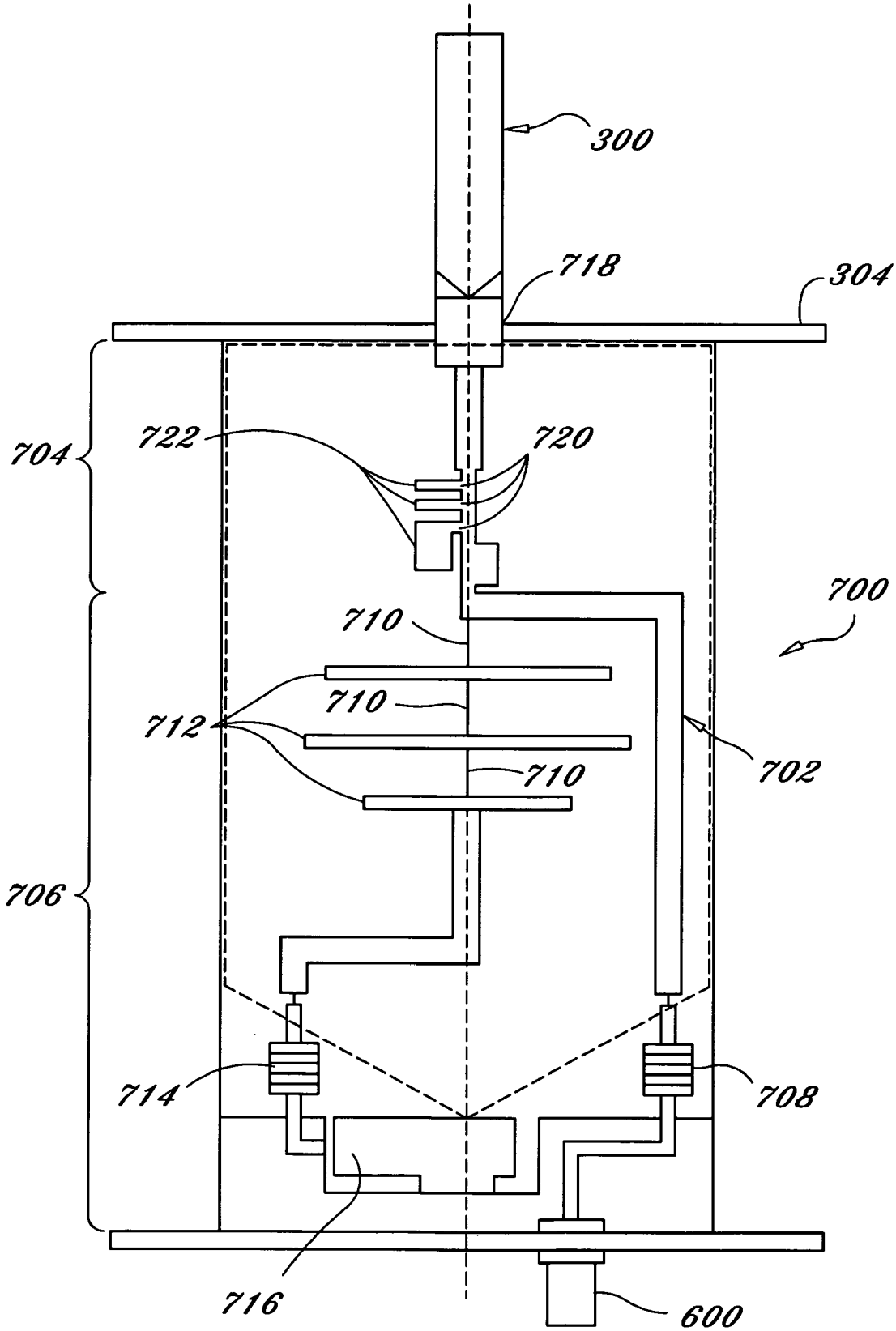
FIG. 7 is a diagram illustrating the inventive antenna assembly, including a diplexer, according to an embodiment of the present invention.

As has been described, and can be seen in FIG. 4, conductive material 106 is only on one side of the dielectric material 102 forming the LFE 100. Therefore, the remaining side is free and available surface area. Referring now to FIG. 7, one embodiment of the inventive antenna assembly 700 is shown, which includes the LFE 100, the HFE 300, the connector 600, and a diplexer 702 disposed on the dielectric 102 opposite the area of conductive material 106.

Diplexer 702 is a filter with two parallel branches that either pass or impede specific frequencies or ranges of frequencies. In the particular embodiment shown in FIG. 7, branch 704 allows frequencies from approximately 1 GHz to 2 GHz to pass while rejecting frequencies outside of that band. Branch 706 allows frequencies of approximately 225 MHz to 1 GHz to pass, while rejecting or impeding frequencies outside of that band. At least one inventive feature of the present invention is that diplexer 702 makes it possible to feed two separate elements 100, 300 of the antenna assembly 700 distinct frequency bands with only one connector 600.

The diplexer 702 is realized with microstrip pathways located on the dielectric 102 as well as other circuit components. Diplexers require a ground plane for proper operation. The diplexer 702 utilizes the conductive area 106 as the ground plane for the microstrip pathways. Many embodiments of the diplexer 702 are possible and can accomplish the goals of the present invention. The particular diplexer shown in FIG. 7 and explained in the preceding paragraphs is for exemplary purposes only. One type of exemplary diplexer, which is a standalone device, but accomplishes a goal similar to the diplexer of the present invention is available from Microwave Circuits, Inc., located at 6856 Eastern Avenue, NW, Washington, D.C. 20012, part number D1G03G01.

Impedance of the microstrip structure will be a function of the physical dimensions of the trace and the dielectric constant of the material 102. For example, a trace of a fixed length and width will appear as a short to a DC or low-frequency signal. However, as the frequency increases, so too does the impedance of the trace. At a certain frequency, the trace begins to appear inductive. At a high enough frequency, the same trace that electrically appeared as a short circuit at the low frequency will present an electrical open in the circuit, blocking all high-frequency current. Alternatively, a capacitor at a low frequency appears as an open circuit. As the frequency increases, however, the capacitor easily induces a voltage on the opposite side of the gap and the component approaches the behavior of a short circuit.

By utilizing an etching technique known to those of skill in the art, a microstrip diplexer circuit 702 can be formed on the surface of dielectric 102 opposite the conductive material 106, as shown in FIG. 7. A signal, which may contain both frequency bands, is fed into the connector 600, through an RF choke 708, through a common path 710, and into either the high-pass section 704 or the low-pass section 706. The low-pass section is formed with series inductors 710 and shunt capacitors 712 followed by an RF choke 714 and a low-frequency band impedance matching network 716. Only the lower frequencies will be able to pass the inductive pathway and the higher frequencies are impeded by the shunt inductance as a short circuit to ground. Conversely, the high-pass section 704 is formed by series capacitors 720 and shunt inductors 722 followed by a high-frequency impedance matching network 718. In the high-pass section 704 the lower frequency signals are blocked by the capacitors and pass to ground through the inductors. The diplexer may include a fewer or greater number of components than those shown in the FIG. 7 and described above. The complexity of the diplexer is a function of performance and cost requirements of the antenna assembly.

Although a diplexer is shown, triplexers, quadplexers, or any number of filters can be realized on an element as has been described. In addition, a number of elements other than two can be co-located similarly to the LFE 100 and HFE 300 and with the LFE 100 and HFE 300 and electrically fed through the above-mentioned filter devices.

Both the LFE 100 and the HFE 300 have impedance matching networks between the last stage of the diplexer and the elements. The function of the impedance matching network is to "match" the antenna impedance of each element to the impedance of the propagating medium, which is usually air or free space.

In one embodiment of the present invention, thru-holes are provided in the dielectric material 102 and electrical connections are made between the diplexer components and the conductive material 106.

Finally, an outer protective shell is placed over the elements 100 & 300 and the diplexer 702 to protect them from environmental conditions. The shell is secured to the base plate 104 and sealed to prevent moisture intrusion. In one embodiment, a foam-type substance is placed within the shell to further support the antenna components from shock, moisture intrusion, and other similar conditions.

It should be clear from the above description that the present invention can be used for transmitting as well as receiving. While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A multiband antenna assembly, comprising:

a first element with a first surface and a second surface opposite the first surface;

a conductive material disposed on the first surface of the first element for at least communicating a first frequency band of electromagnetic waves;

a second element for at least communicating a second frequency band of electromagnetic waves, the second element physically coupled to the first element and communicating in a same radiation orientation as the first element;

an electrical connector for electrically communicating the first frequency band and the second frequency band of electromagnetic waves with the first element and the second element; and a frequency dividing circuit disposed at least partially on the second surface of the first element, the frequency dividing circuit for impeding the second frequency band of radio waves from being communicating by the first element and for impeding the first frequency band of radio waves from being communicating by the second element.

2. The multiband antenna assembly according to claim 1, wherein the electrical connector comprises:

one of a BNC, a TNC, an N-type, and an SMA connector.

3. The multiband antenna assembly according to claim 1, wherein the first element comprises:

an electrically non-conductive material.

4. The first element according to claim 3, wherein the electrically non-conductive material is substantially flat and rectilinear in shape.

5. The first element according to claim 3, wherein the electrically conductive pathway includes at least one of an inductor and a capacitor, which are disposed directly opposite the conductive material on the first side.

6. The multiband antenna assembly according to claim 1, wherein the second element is disposed directly above the first element.

7. The multiband antenna assembly according to claim 6, further comprising:

an electrically conductive plate disposed between the first element and the second element.

8. The multiband antenna assembly according to claim 7, wherein the plate is circular in shape.

9. The multiband antenna assembly according to claim 1, wherein the frequency dividing circuit includes a high-pass filter and a low-pass filter.

10. The frequency dividing circuit according to claim 9, wherein the low-pass filter passes frequencies from about 225 MHz to 1000 MHz.

11. The frequency dividing circuit according to claim 9, wherein the high-pass filter passes frequencies from about 1000 MHz to 2000 MHz.

12. The multiband antenna assembly according to claim 1, wherein the first and second element are operable to receive electromagnetic waves.

13. The multiband antenna assembly according to claim 1, wherein the first and second element are operable to transmit electromagnetic waves.

14. The multiband antenna assembly according to claim 1, wherein the frequency dividing circuit comprises:

at least one electrically conductive pathway, including at least one of an element of impedance and an element of capacitance, disposed on the second surface and in electrical communication with the conductive material on the first surface.

* * * * *

UNITED STATES PATENT AND TRADEMARK OFFICE

CERTIFICATE OF CORRECTION

PATENT NO. : 7,098,862 B2
APPLICATION NO. : 10/973230
DATED : August 29, 2006
INVENTOR(S) : Florenio Pinili Regala It is certified that error appears in the above-identified patent and that said Letters Patent is hereby corrected as shown below:

On the title page, item [73] change:
Assignee: "FPR Enterprises, LLC," to -- Florenio Pinili Regala, an individual, --

Signed and Sealed this

Twenty-seventh Day of November, 2007

JON W. DUDAS
*Director of the United States Patent and Trademark Office*